US007758681B2

(12) United States Patent
Lee et al.

(10) Patent No.: US 7,758,681 B2
(45) Date of Patent: Jul. 20, 2010

(54) COBALT-BASED ALLOY ELECTROLESS PLATING SOLUTION AND ELECTROLESS PLATING METHOD USING THE SAME

(75) Inventors: Sang-chul Lee, Daejeon (KR); Min-kyoun Kim, Kwangmyung-si (KR); Min-jin Ko, Daejeon (KR)

(73) Assignee: LG Chem, Ltd., Seoul (KR)

( * ) Notice: Subject to any disclaimer, the term of this patent is extended or adjusted under 35 U.S.C. 154(b) by 829 days.

(21) Appl. No.: 11/647,283

(22) Filed: Dec. 29, 2006

(65) Prior Publication Data

US 2007/0160857 A1 Jul. 12, 2007

(30) Foreign Application Priority Data

Dec. 29, 2005 (KR) ..... 10-2005-0133505

(51) Int. Cl.
*C23C 18/34* (2006.01)
*B05D 1/18* (2006.01)

(52) U.S. Cl. ..... 106/1.22; 106/1.27; 427/437; 427/443.1

(58) Field of Classification Search ..... 106/1.22, 106/1.27; 427/437, 443.1
See application file for complete search history.

(56) References Cited

U.S. PATENT DOCUMENTS 3,234,031 A * 2/1966 Zirngiebl et al. ..... 106/1.27
4,486,233 A 12/1984 Josso et al.
4,844,739 A * 7/1989 Josso et al. ..... 106/1.27
5,645,628 A * 7/1997 Endo et al. ..... 106/1.23
6,645,364 B2 * 11/2003 Calvert et al. ..... 205/81
6,717,189 B2 * 4/2004 Inoue et al. ..... 257/200
6,773,573 B2 * 8/2004 Gabe et al. ..... 205/296
6,790,265 B2 * 9/2004 Joshi et al. ..... 106/1.17
6,824,597 B2 * 11/2004 Heber et al. ..... 106/1.22
6,863,795 B2 * 3/2005 Teerlinck et al. ..... 205/210
6,911,068 B2 * 6/2005 Cobley et al. ..... 106/1.27
7,332,193 B2 * 2/2008 Valverde et al. ..... 427/99.5
7,407,689 B2 * 8/2008 Joshi et al. ..... 427/309
2002/0081842 A1 * 6/2002 Sambucetti et al. ..... 438/678

FOREIGN PATENT DOCUMENTS

KR 10-2004-0008205 12/2003

* cited by examiner

*Primary Examiner*—Helene Klemanski
(74) *Attorney, Agent, or Firm*—McKenna Long & Aldridge LLP

(57) ABSTRACT

A cobalt-based alloy electroless plating solution according to the present invention comprises a cobalt precursor, a tungsten precursor, a phosphorus precursor, a reducing agent, a complexing agent, a pH regulator and a stabilizer, in which the reducing agent is dimethylamine borane (DMAB) or borohydride and the stabilizer is one or more compounds selected from a group consisting of imidazole, thiazole, triazole, disulfide and their derivatives; and which is stable enough for long-term reuse and prevents deterioration of metal thin-film quality by inhibiting the formation of a precipitate.

16 Claims, 1 Drawing Sheet

【FIG. 1】
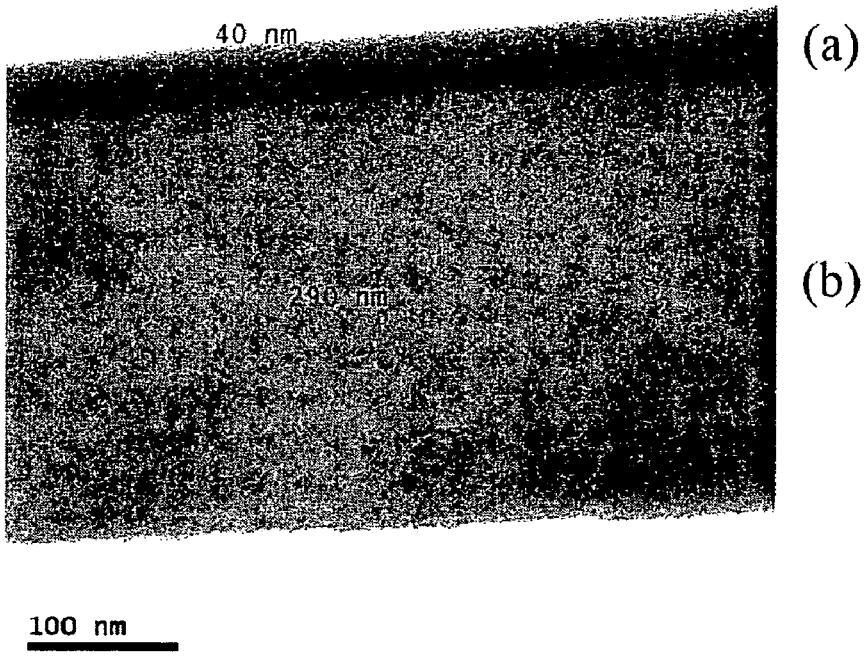
【FIG. 2】
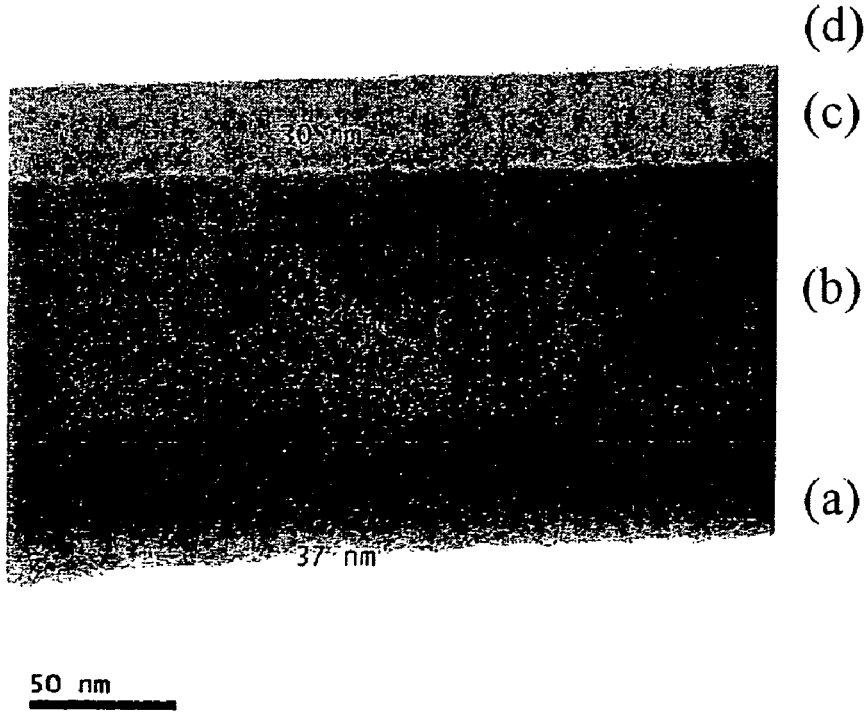

COBALT-BASED ALLOY ELECTROLESS PLATING SOLUTION AND ELECTROLESS PLATING METHOD USING THE SAME

This application claims the benefit of the filing date of Korean Patent Application No. 10-2005-0133505 filed on Dec. 29, 2005 in the Korean Intellectual Property Office, the disclosure of which is incorporated herein in its entirety by reference.

TECHNICAL FIELD

The present invention relates to a cobalt-based alloy electroless plating solution and an electroless plating method using the same, and more precisely, a cobalt-based alloy electroless plating solution which is stable enough to be reused several times and prevents degradation of metal thin-film quality due to formation of a precipitate; and an electroless plating method characterized by immersion in, or spraying of, the same.

BACKGROUND ART

With recent increases in the packing density of semiconductor devices, conventional aluminum wiring material must be replaced with copper to reduce signal retardation and to improve electromigration resistance. However, when copper is used as a wiring material, the copper is diffused into an interlayer insulating film (for example, a silicon oxide layer) which defines the wiring. To solve this problem, a diffusion barrier layer (formed on the side wall and the bottom of copper wiring) and a capping layer (formed on the upper part of copper wiring) are formed between copper wires, and an interlayer insulating film is applied to prevent direct contact.

A silicon nitride layer has been used up to now as a capping layer for copper wiring. However, in addition to poor adhesion to copper, the silicon nitride layer has a different thermal expansion coefficient to the interlayer insulating film formed on the upper part of the capping layer, for example a silicon oxide layer, so mechanical stress is concentrated between the capping layer and the interlayer insulating film, resulting in the separation of the capping layer (silicon nitride film) from the upper part of the copper wiring. When the capping layer is separated from the copper wiring, the diffusion of copper into the interlayer insulating film will not be inhibited. Owing to the huge difference in permittivity of the silicon nitride film, the volume of parasitic capacitance increases, which causes retardation of the driving speed of a semiconductor device by RC retardation.

Thus, a cobalt-based alloy has been proposed as an alternative, which seems to have excellent adhesion to copper wiring and low permittivity and prevents the diffusion of copper into an interlayer insulating film. The cobalt-based alloy contains cobalt as a major component and additionally includes metals such as tungsten, boron, phosphorus, etc. To form a cobalt-based alloy thin film selectively on the upper part of copper wiring, electroless plating has been proposed.

Electroless plating is a method of forming a metal thin-film by reducing a metal ion using an electron generated through oxidation of a reducing agent on the surface of a catalyst substrate without any externally supplied electrons. This method has an advantage of forming a metal thin-film specifically on a target area, which is activated by catalyst, of an entire substrate. However, by containing a reducing agent the plating solution becomes unstable, according to the plating conditions, and thus autolysis occurs. Autolysis indicates that a metal ion is reduced not on the surface of a catalyst substrate, but in the plating solution, thus forming a precipitate. This autolysis brings about the loss of metal particles, resulting in a decrease in the durability of the solution (shortening the life of the solution) and a decrease in the quality of the metal thin-film due to the formation of a precipitate in the solution.

To apply a cobalt-based alloy on the upper part of copper wiring by electroless plating, dimethylamine borane (DMAB), which is easily oxidized on the surface of copper, has to be used as a reducing agent considering the low catalytic activity of copper, and the temperature for the process has to be high. However, in this case the electroless plating solution becomes chemically unstable, so autolysis occurs easily.

DISCLOSURE OF THE INVENTION

In order to solve the above problems, the present invention provides a cobalt-based alloy electroless plating solution which is stable enough to inhibit autolysis and to be reused several times, and is able to prevent the deterioration of metal thin-film quality due to the formation of a precipitate in the solution.

The present invention also provides an electroless plating method characterized by immersion in, or spraying of, the cobalt-based alloy electroless plating solution, and a thin film prepared using the same.

An embodiment of the present invention provides a cobalt-based alloy electroless plating solution comprising: a cobalt precursor, a tungsten precursor, a phosphorus precursor, a reducing agent, a complexing agent, a pH regulator and a stabilizer, in which the reducing agent is dimethylamine borane (DMAB) or borohydride and the stabilizer is one or more compounds selected from a group consisting of imidazole, thiazole, triazole, disulfide and their derivatives.

Another embodiment of the present invention provides an electroless plating method characterized by immersion in, or spraying of, the cobalt-based alloy electroless plating solution, and a thin film prepared using the same.

Hereinafter, the present invention is described in detail.

Conventional reducing agents, including hypophosphite, are not appropriate for forming a capping layer on the upper part of copper wiring by cobalt-based alloy electroless plating because the conventional reducing agents are not easily oxidized on the surface of copper, making plating difficult. Thus dimethylamine borane (DMAB) or borohydride, which is easily oxidized on the surface of copper, is required as a reducing agent to form a capping layer. However, using DMAB or borohydride as a reducing agent increases the chances of autolysis since plating with the reducing agent has to be performed at high temperature, which decreases the chemical stability. Therefore, the present invention tries to inhibit autolysis by adding a stabilizer to the cobalt-based alloy electroless plating solution.

The cobalt-based alloy electroless plating solution of the present invention is comprised of: a cobalt precursor, a tungsten precursor, a phosphorus precursor, a reducing agent, a complexing agent, a pH regulator and a stabilizer, in which the reducing agent is dimethylamine borane (DMAB) or borohydride and the stabilizer is one or more compounds selected from a group consisting of imidazole, thiazole, triazole, disulfide and their derivatives.

The cobalt precursor is one or more compounds selected from a group consisting of cobalt sulfate, cobalt chloride and cobalt ammonium sulphate. Among these compounds, cobalt sulfate heptahydrate is preferred. The preferable content of the cobalt precursor is 0.5~5.0 g/L considering reaction speed and plating time.

The tungsten precursor is one or more compounds selected from a group consisting of ammonium tungstate, sodium tungstate and tetramethyl ammonium tungstate, and among these ammonium tungstate is preferred. The content of the tungsten precursor may be controlled to regulate the composition of a capping layer, and the preferable content of the tungsten precursor is 0.1~1.0 g/L.

The phosphorus precursor is one or more compounds selected from a group consisting of ammonium hypophosphite, ammonium dihydrogen phosphate and phosphoric acid, and among these compounds ammonium dihydrogen phosphate is preferred. The content of the phosphorus precursor can be controlled to regulate the composition of a capping layer, and the preferable content of the phosphorus precursor is 1.0~5.0 g/L.

The reducing agent is a compound that provides an electron necessary for the reduction of a metal ion by oxidation. The reducing agent herein is dimethylamine borane (DMAB) or borohydride. Considering the reaction speed and plating time, as well as the stability of the plating solution, the preferable content of the reducing agent is 0.5~10.0 g/L, and 3.0~5.0 g/L is more preferred.

The complexing agent is a compound that forms a complex with a metal ion in an electroless plating solution to stabilize the metal ion, which can be one or more compounds selected from a group consisting of citric acid, ammonium citrate, sodium citrate, tetramethyl ammonium citrate and ethylene diamine tetraacetic acid (EDTA). Among these compounds, citric acid (anhydrous) is preferred. The preferable content of the complexing agent is 3.0~15.0 g/L.

The pH regulator plays a role in regulating hydroxylation of an electroless plating solution to maintain the proper pH for the reaction, and can be one or more compounds selected from a group consisting of potassium hydroxide (KOH), ammonium hydroxide and tetramethyl ammonium hydroxide (TMAH). Among these compounds tetramethyl ammonium hydroxide (TMAH) is preferred. The preferable content of the pH regulator is 10~40 mL/L.

The stabilizer forms a complex with a metal ion to suppress the generation of a metal particle, or is absorbed onto the surface of a metal particle to inhibit the growth of the metal particle in an electroless plating solution, resulting in the enhancement of the stability of the electroless plating solution.

The stabilizer included in an electroless plating solution plays a role in inhibiting autolysis at high temperature and the long term maintenance of the properties of the solution so the solution is stable, minimizes the deceleration of electroless plating reaction speed, and thereby forms a cobalt-based alloy thin film on a copper thin film.

The stabilizer is one or more compounds selected from a group consisting of imidazole, thiazole, triazole, disulfide and their derivatives. To minimize the deceleration of the plating speed, 4,5-dithiaoctane-1,8-disulfonic acid, 3-(2-benzothiazolethio)-1-propane sulfonic acid, N,N-dimethyl dithiocarbamic acid(3-sulfopropyl)ester (DPS) or 3-mercapto-1-propanesulfonate (MPSA) is preferably used. The preferable content of the stabilizer in a cobalt-based alloy electroless plating solution is 0.001 mg/L~1 g/L.

The preferable pH of the cobalt-based alloy electroless plating solution is 8~10.

The electroless plating method of the present invention is characterized by immersion in, or spraying of, the cobalt-based alloy electroless plating solution.

In the process of semiconductor wiring, copper wiring is electroplated on the damascene structure formed by etching. The surface of the copper formed as described is planarized so it is smooth. However, if the surface of copper on which electroless plating is performed is oxidized or includes impurities, the electroless plating will not be completed satisfactorily. Therefore, copper oxide or impurities have to be eliminated by a semiconductor cleaning process before the electroless plating. Therefore, the electroless plating method of the present invention can additionally include a pre-treatment process of cleaning the copper substrate on which electroless plating will be performed after planarizing.

The electroless plating method of the present invention is achieved by either dipping a substrate which will be the base for a capping layer in an electroless plating solution for a required amount of time, or spraying an electroless plating solution on a substrate that will be the base for a capping layer.

The electroless plating method of the present invention using the cobalt-based alloy electroless plating solution containing a stabilizer might reduce the electroless plating speed. Therefore, it is preferred to quickly form a cobalt-based alloy thin film on the copper thin film while keeping the solution stable and minimizing the deceleration of the electroless plating speed.

The electroless plating reaction temperature is a crucial factor that affects the stability of the electroless plating solution and the plating speed. The higher the temperature goes, the lower the stability is and the faster the plating speed becomes. On the contrary, the lower the temperature goes, the higher the stability is and the slower the plating speed becomes.

According to the electroless plating method of the present invention, the preferable temperature for forming a capping layer on a substrate with an electroless plating solution is 15~95° C., and more preferably 70~90° C.

The duration of the electroless plating process depends on the thickness of the cobalt-based alloy thin film. That is, according to the thickness that the cobalt-based alloy thin film will be prepared at, the electroless plating time will be within one hour, or preferably within 10 minutes, and more preferably within 2 minutes.

According to the electroless plating method of the present invention, the thickness of a cobalt-based alloy thin film formed on a substrate can be regulated. The preferable thickness of a cobalt-based alloy thin film is up to 100 nm, and more preferably up to 10 nm.

BRIEF DESCRIPTION OF THE DRAWINGS

The application of the preferred embodiments of the present invention is best understood with reference to the accompanying drawings, wherein:

FIG. 1 is a TEM photograph of the cobalt-based alloy thin film formed by using the cobalt-based alloy electroless plating solution containing 4,5- dithiaoctane-1,8-disulfonic acid of Example 1.

FIG. 2 is a TEM photograph of the cobalt-based alloy thin film formed by using the cobalt-based alloy electroless plating solution containing 3-(2-benzothiazolethio)-1-propane sulfonic acid of Example 2.

BEST MODE FOR CARRYING OUT THE INVENTION

Practical and presently preferred embodiments of the present invention are illustrated as shown in the following examples.

However, it will be appreciated that those skilled in the art, on consideration of this disclosure, may make modifications and improvements within the spirit and scope of the present invention.

EXAMPLES

Example 1

<Preparation of a Cobalt-based Alloy Electroless Plating Solution>

0.01 M of cobalt sulfate heptahydrate, 0.04 M of citric acid, 0.5 g/L of ammonium tungstate, 0.06 M of DMAB and 0.03 M of dihydrogen phosphate were mixed, and the pH of the mixture was adjusted to 9 by using TMAH. 0.01 g/L of 4,5-dithiaoctane-1,8-disulfonic acid was added thereto as a stabilizer to prepare a cobalt-based alloy electroless plating solution with improved stability.

The prepared electroless plating solution was heated in water at 95° C. 30 minutes later the temperature of the solution reached 90° C., and the solution was stable for over 12 hours.

<Preparation of a Cobalt-based Alloy Electroless Plating Thin Film>

A planarized copper wiring substrate was prepared for the cobalt-based alloy electroless plating. The prepared substrate was immersed in ammonia solution (1:200) for 30 seconds to eliminate copper oxides generated on the surface of the substrate. The substrate was then washed with distilled water to eliminate any remaining impurities.

The prepared substrate was immersed for 1 minute in the cobalt-based alloy electroless plating solution, which was standing at 90° C., thus completing the cobalt-based alloy electroless plating method.

FIG. 1 is a TEM photograph of the prepared electroless plating thin film. In FIG. 1, (a) illustrates the cobalt-based alloy thin film formed by the electroless plating and (b) illustrates the copper thin film. As shown in FIG. 1, a 40 nm thick electroless plating thin film with excellent surface properties was prepared by using the stable cobalt-based alloy electroless plating solution.

Example 2

<Preparation of a Cobalt-based Alloy Electroless Plating Solution>

A cobalt-based alloy electroless plating solution was prepared in the same manner as described in Example 1, except that 0.01 g/L of 3-(2-benzothiazolethio)-1-propane sulfonic acid was added as a stabilizer.

The prepared electroless plating solution was heated in water at 84° C. 30 minutes later the temperature of the solution reached 80° C., and the solution was stable for over 12 hours.

<Preparation of a Cobalt-based Alloy Electroless Plating Thin Film>

An experiment was performed in the same manner as described in Example 1, except that the cobalt-based alloy electroless plating solution prepared in Example 2 was used and it was kept at 80° C.

FIG. 2 is a TEM photograph of the prepared electroless plating thin film. In FIG. 2, (a) illustrates the cobalt-based alloy thin film formed by electroless plating, (b) indicates the copper thin film, (c) indicates the diffusion barrier layer and (d) illustrates the silicon wafer substrate. As shown in FIG. 2, a 37 nm thick electroless plating thin film with excellent surface properties was prepared by using the stable cobalt-based alloy electroless plating solution.

Comparative Example 1

<Preparation of a Cobalt-based Alloy Electroless Plating Solution>

A cobalt-based alloy electroless plating solution was prepared in the same manner as described in Example 1, except the stabilizer used in Example 1 was excluded.

The prepared electroless plating solution was heated in water at 95° C. After 20 minutes from the start of heating, air bubbles began to generate in the solution, autolysis was observed, and a gray precipitate was generated from the reaction.

<Preparation of a Cobalt-based Alloy Electroless Plating Thin Film>

An experiment was performed in the same manner as described in Example 1, except the cobalt-based alloy electroless plating solution prepared in Comparative Example 1 was used and it was kept at 90° C.

As a result, a gray precipitate resulting from autolysis was found in the bottom of the reactor and a thin film was not formed.

Comparative Example 2

<Preparation of a Cobalt-based Alloy Electroless Plating Solution>

A cobalt-based alloy electroless plating solution was prepared in the same manner as described in Example 1, except the stabilizer used in Example 1 was excluded.

The prepared electroless plating solution was heated in water at 84° C. After 20 minutes from the start of heating, air bubbles began to generate in the solution, autolysis was observed, and a gray precipitate was generated from the reaction.

<Preparation of a Cobalt-based Alloy Electroless Plating Thin Film>

An experiment was performed in the same manner as described in Example 1, except the cobalt-based alloy electroless plating solution prepared in Comparative Example 2 was used and it was kept at 80° C.

As a result, a gray precipitate resulting from autolysis was found in the bottom of the reactor, and a thin film was not formed.

INDUSTRIAL APPLICABILITY

As explained hereinbefore, the present invention provides a cobalt-based alloy electroless plating solution having excellent stability that is able to be reused many times, and does not form a precipitate thereby preventing the deterioration of metal thin-film properties. In addition, the present invention provides an electroless plating method using the above solution and a cobalt-based alloy thin film using the said method.

Those skilled in the art will appreciate that the conceptions and specific embodiments disclosed in the foregoing description may be readily utilized as a basis for modifying or designing other embodiments for carrying out the same purposes of the present invention. Those skilled in the art will also appreciate that such equivalent embodiments do not depart from the spirit and scope of the invention as set forth in the appended claims.

The invention claimed is:

1. A cobalt-based alloy electroless plating solution comprising: a cobalt precursor, a tungsten precursor, a phosphorus precursor, a reducing agent, a complexing agent, a pH regulator and a stabilizer, in which the reducing agent is dimethylamine borane (DMAB) or borohydride and the stabilizer is one or more compounds selected from a group consisting of 4,5-dithiaoctane-1,8-disulfonic acid and 3-(2-benzothiazolethio)-1-propane sulfonic acid.

2. The cobalt-based alloy electroless plating solution according to claim 1, wherein the cobalt precursor is one or more compounds selected from a group consisting of cobalt sulfate, cobalt chloride and cobalt ammonium sulphate.

3. The cobalt-based alloy electroless plating solution according to claim 1, wherein the tungsten precursor is one or more compounds selected from a group consisting of ammonium tungstate, sodium tungstate and tetramethyl ammonium tungstate.

4. The cobalt-based alloy electroless plating solution according to claim 1, wherein the phosphorus precursor is one or more compounds selected from a group consisting of ammonium hypophosphite, ammonium dihydrogen phosphate and phosphoric acid.

5. The cobalt-based alloy electroless plating solution according to claim 1, wherein the complexing agent is one or more compounds selected from a group consisting of citric acid, ammonium citrate, sodium citrate, tetramethyl ammonium citrate and ethylene diamine tetraacetic acid (EDTA).

6. The cobalt-based alloy electroless plating solution according to claim 1, wherein the pH regulator is one or more compounds selected from a group consisting of potassium hydroxide (KOH), ammonium hydroxide and tetramethyl ammonium hydroxide (TMAH).

7. The cobalt-based alloy electroless plating solution according to claim 1, wherein the pH of the cobalt-based alloy electroless plating solution is 8~10.

8. The cobalt-based alloy electroless plating solution according to claim 1, wherein the content of the stabilizer in the cobalt-based alloy electroless plating solution is 0.001 mg/L~1 g/L.

9. An electroless plating method characterized by using the cobalt-based alloy electroless plating solution of claim 1.

10. The electroless plating method according to claim 9, wherein the electroless plating is characterized by immersing a substrate, upon which a capping layer will be formed, in the cobalt-based alloy electroless plating solution to form a capping layer.

11. The electroless plating method according to claim 9, wherein the electroless plating is characterized by spraying the cobalt-based alloy electroless plating solution on a substrate upon which a capping layer will be formed.

12. The electroless plating method according to claim 10, wherein the electroless plating is performed with the cobalt-based alloy electroless plating solution at 15~95° C.

13. The electroless plating method according to claim 9, wherein the duration of the electroless plating is up to one hour.

14. The electroless plating method according to claim 9, wherein the electroless plating method additionally includes a pre-treatment step of cleaning the copper surface after a planarizing process.

15. The electroless plating method according to claim 9, wherein the thickness of the cobalt-based alloy thin film formed by the electroless plating is up to 100 nm.

16. A cobalt-based alloy thin film prepared by the electroless plating method of claim 9.

* * * * *